US010636610B2

(12) United States Patent
English, II

(10) Patent No.: US 10,636,610 B2
(45) Date of Patent: Apr. 28, 2020

(54) TARGET GEOMETRY FOR SMALL SPOT X-RAY TUBE

(71) Applicant: Thermo Scientific Portable Analytical Instruments Inc., Tewksbury, MA (US)

(72) Inventor: William Ferneau English, II, Tewksbury, MA (US)

(73) Assignee: THERMO SCIENTIFIC PORTABLE ANALYTICAL INSTRUMENTS INC., Tewksbury, MA (US)

( * ) Notice: Subject to any disclaimer, the term of this patent is extended or adjusted under 35 U.S.C. 154(b) by 205 days.

(21) Appl. No.: 15/964,035

(22) Filed: Apr. 26, 2018

(65) Prior Publication Data

US 2018/0315577 A1 Nov. 1, 2018

Related U.S. Application Data

(60) Provisional application No. 62/491,606, filed on Apr. 28, 2017.

(51) Int. Cl.
*H01J 35/18* (2006.01)
*H01J 35/08* (2006.01)

(52) U.S. Cl.
CPC ..... *H01J 35/08* (2013.01); *H01J 35/18* (2013.01); *H01J 2235/086* (2013.01)

(58) Field of Classification Search
CPC .. H01J 35/00; H01J 35/08; H01J 35/18; H01J 35/02; H01J 35/147; H01J 35/16; H01J 35/32; H01J 35/06; H01J 35/04; H01J 35/112; H01J 2235/00; H01J 2235/086; H01J 5/18; A61B 6/44
USPC ..... 378/119, 121, 122, 136, 140, 143
See application file for complete search history.

(56) References Cited

U.S. PATENT DOCUMENTS 1,326,029 A 12/1919 Coolidge
6,075,839 A 6/2000 Treseder

*Primary Examiner* — Jurie Yun
(74) *Attorney, Agent, or Firm* — William R McCarthy, III

(57) ABSTRACT

An embodiment of an X-ray tube is described that comprises an outer cylinder; a window positioned on an end of the outer cylinder; an electron gun comprising an emission orifice, wherein the electron gun is coupled to a side of the outer cylinder at an angle that orients the emission orifice toward the window; and a rod centrally positioned within the outer cylinder, wherein the rod comprises a concave geometry at a distal end proximal to the electron gun and a target surface configured at an angle that orients the target surface towards the emission orifice, wherein the concave geometry is configured to position the target surface to have a focal spot size of an electron beam from the emission orifice in range of about 2-6 μm.

16 Claims, 4 Drawing Sheets

TARGET GEOMETRY FOR SMALL SPOT X-RAY TUBE

CROSS-REFERENCE TO RELATED APPLICATION

This application claims the benefit of U.S. provisional patent application No. 62/491,606, filed Apr. 28, 2017. The contents of this application are incorporated by reference in their entirety.

FIELD OF THE INVENTION

The presently described invention relates generally to the field of x-ray Tube Technology. More specifically, the invention pertains to a new configuration for an x-ray tube designed to produce a very small x-ray spot with a large angle of illumination while at the same time efficiently dissipating heat from the target.

BACKGROUND OF THE INVENTION

X-ray tube technology is well known and some embodiments include a vacuum tube configured with a cathode that emits electrons that collide with an anode "target" to produce x-ray emissions. Those of ordinary skill in the art appreciate that x-ray emissions are used for a variety of applications that typically include directing the x-rays at a sample and measuring a response. One particular application includes what is generally referred to as "High Resolution Imaging" that relies on a very small spot size to provide a high degree of resolution, preferably with a substantial degree of power. For example high resolution imaging with good off-axis detection is an important technology in the semiconductor manufacturing industry where highly accurate 3-dimensional images provide various benefits such as quality control for the manufacturing process.

One particular x-ray tube configuration includes what is referred to as an "end-window" configuration that directs x-ray emissions through a planar window towards the surface of the sample. The end-window type of tubes can further be divided into two classes such as what are referred to as "transmission" based tubes and "reflection" based tubes. For example, embodiments of transmission type tubes typically position the anode in the path of an electron beam directed to the sample from the cathode. In this way the electron beam passes through the anode which produces x-ray emissions that interact with the sample. This type of configuration produces excessive amounts of heat that limits the amount of power that can be used. Further, passing the electron beam through the anode attenuates the power of the electrons as they pass through (e.g. amount of attenuation depends, at least in part, upon the thickness of the anode material).

Alternatively, reflection type tubes have an anode positioned within the vacuum chamber, where the anode comprises a target face (also referred to as a reflection target, a reflective surface, a target face, or a target surface, each of which may be used interchangeably herein) in proximity to an electron gun type cathode. The electron gun emits an electron beam that interacts with the target surface to produce x-ray emissions that are "reflected" through the window. Reflection type tubes typically produce less heat than a transmission type tube thus enabling use of higher power as well as a higher efficiency of power delivery to the sample (e.g. because there is substantially no attenuation from the anode material).

Importantly, the target anode of reflection type x-ray tube configurations have a number of technical aspects that must be considered for reliable operation. First, the target anode must accurately intersect with an electron beam to allow the creation of characteristic x-rays that are directed towards an output window. A second consideration is that the target anode should be maintained at a high voltage potential that is substantially equal to the operating voltage of the tube while being positioned in close proximity to structures that should be maintained at ground potential (e.g. the electron gun, outer cylinder, etc.). As those skilled in the art appreciate, large differences in voltage potential of objects located in close proximity to one another can often result in arcing problems.

A third consideration is that target anode structure must also efficiently carry heat away from the target surface where the electron beam is focused, which produces the x-ray emissions and heat. Again, it is appreciated that if the target anode configuration lacks sufficient heat transfer characteristics it may be inoperable, or at least require a reduced level of power that could be used in order to avoid overheating and possible damage to the target anode structure.

A fourth consideration is that the configuration of the target anode structure effects the characteristics of the electric field in the x-ray tube which in turn affects the electron trajectory and voltage standoff distance characteristics (e.g. standoff voltage distance includes a distance where arc-over between the cathode and the anode does not occur). It will further be appreciated that optimization of one consideration can have a negative impact on another consideration, and thus the relative impacts on performance should be contemplated. For example, the thermal transfer capacity of a target anode structure is limited by the cross-sectional area, where a large anode cross section carries more heat but can compromise voltage standoff distance from other objects such as an electron gun.

One target anode configuration that has been employed comprises a long rod with a beveled end to improve the spacing between the target surface of the anode facing the cathode and other structures maintained at ground potential. The beveled end can also be positioned in closer proximity to the window as compared to non-beveled embodiments due to a better voltage standoff distance. This is a very simple and cost effective solution, but has limitations as to the considerations described above. For example, with a straight rod structure there is a compromise between window proximity and electron gun proximity in order to maintain adequate voltage standoff distances to avoid arc-over.

Another possible target anode configuration includes a rectangular rod structure that is stepped down in the distal portion to allow for a relatively close proximity to the window similar to the beveled end embodiments described above. This helps to overcome the configuration problem of the straight rod, but makes the angles of intersection with the electron beam difficult. For example, the stepped down configuration lengthens the electron path between the electron gun cathode and the target anode surface making focusing the x-ray emissions a challenge. Additionally, the sharp transitions in cross-section create high voltage stress points that reduce the voltage standoff in the tube and affect the characteristics of the electric field.

Therefore, it is appreciated that a reflection type x-ray tube design that has a very small focal spot and large cone of illumination while simultaneously providing effective heat dissipation provides a substantial benefit for applications such as High Resolution Imaging.

SUMMARY

An embodiment of an X-ray tube is described that comprises an outer cylinder; a window positioned on an end of the outer cylinder; an electron gun comprising an emission orifice, wherein the electron gun is coupled to a side of the outer cylinder at an angle that orients the emission orifice toward the window; and a rod centrally positioned within the outer cylinder, wherein the rod comprises a concave geometry at a distal end proximal to the electron gun and a target surface configured at an angle that orients the target surface towards the emission orifice, wherein the concave geometry is configured to position the target surface to have a focal spot size of an electron beam from the emission orifice in range of about 2-6 μm.

In some embodiments the concave geometry is configured to position the target surface to have an angle of illumination of x-rays through the window of at least about 130°. Also, the concave geometry may comprise a taper on a side facing the electron gun that decreases a cross section of the rod toward the distal end from a central region of the rod, and/or a lateral taper that decreases a cross section of the rod toward the distal end from a central region of the rod. Further, the concave geometry may substantially complimentary to an outer dimension of electron gun.

Further, in some embodiments the angle of the coupled electron gun is in a range of between about 10° and about 45°, and in some case may include an angle of about 18°. In the same or alternative embodiments the angle of the target surface is in a range of between about 45° and about 85°, and in some cases may include an angle of about 65°.

Additionally, in some embodiments may the target may be constructed of molybdenum (Mo), rhodium (Rh), and tungsten (W) and the rod may be constructed of copper (Cu), graphite (C) and molybdenum (Mo). In the same or alternative embodiments, the rod may have a substantially cylindrical or oval diameter or a polygonal cross section having substantially planar surfaces.

Also, in some embodiments the target surface may be positioned about 0.315 mm from the window and the target surface may be positioned about 0.254 mm from the emission orifice. In the same or alternative embodiments, the focal spot size may include a diameter of about 6 μm.

The above embodiments and implementations are not necessarily inclusive or exclusive of each other and may be combined in any manner that is non-conflicting and otherwise possible, whether they are presented in association with a same, or a different, embodiment or implementation. The description of one embodiment or implementation is not intended to be limiting with respect to other embodiments and/or implementations. Also, any one or more function, step, operation, or technique described elsewhere in this specification may, in alternative implementations, be combined with any one or more function, step, operation, or technique described in the summary. Thus, the above embodiment and implementations are illustrative rather than limiting.

BRIEF DESCRIPTION OF THE DRAWINGS

The above and further features will be more clearly appreciated from the following detailed description when taken in conjunction with the accompanying drawings. In the drawings, like reference numerals indicate like structures, elements, or method steps and the leftmost digit of a reference numeral indicates the number of the figure in which the references element first appears (for example, element 120 appears first in FIG. 1A). All of these conventions, however, are intended to be typical or illustrative, rather than limiting.

Like reference numerals refer to corresponding parts throughout the several views of the drawings.

DETAILED DESCRIPTION OF EMBODIMENTS

As will be described in greater detail below, embodiments of the described invention include an x-ray tube configured with a target anode positioned to have a target surface with a very small focal spot, produce a large angle of illumination, and efficiently dissipate heat generated at the target surface. More specifically, embodiments of the target anode comprise geometry with a "smoothed" transition from a central region where the structure has a large cross section to the target surface which has a relatively small cross section. The geometry also includes a curvature that enables a significantly minimized distance between 1) an electron gun type of cathode to target face, and 2) a window of the x-ray tube to the target surface which provides the large angle of illumination.

Some or all of the embodiments described herein may include one or more elements for operational control of an x-ray tube. For example, embodiments may include one or more processor or controller elements that execute control logic for the tube as well as readable and writeable memory devices that store data.

Embodiments described herein comprise an x-ray tube design configured as a vacuum tube with components that provide a minimum Focus-Object Distance (e.g. FOD), an unobstructed and wide cone of illumination, and high degree of angular manipulation of a sample under test in close proximity to the X-ray source. For example, embodiments of the invention allow positioning an object (also referred to as a sample) under test as close to the window as possible which, among other things, allows for high angular positioning of the object.

Figure 1A:
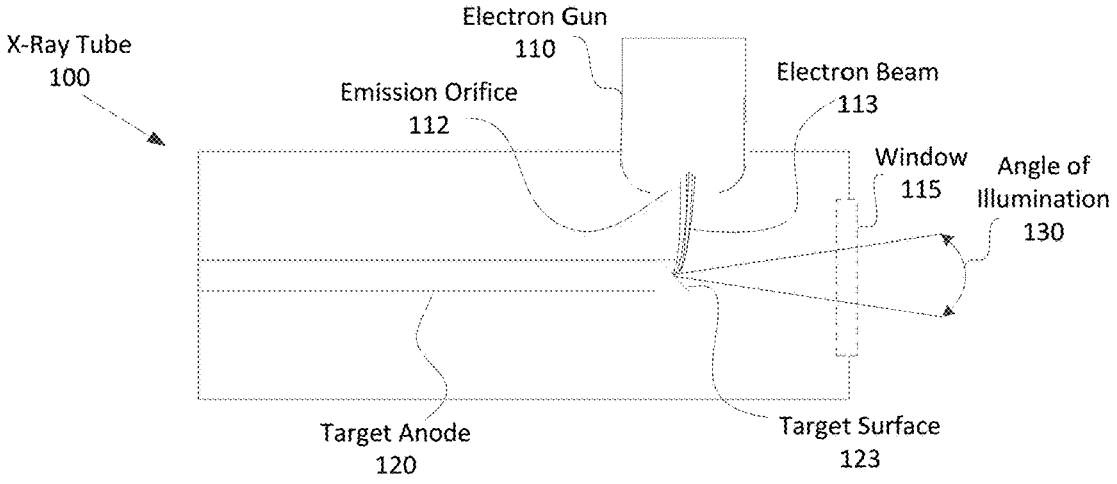
FIGS. 1A-C are simplified graphical representations of embodiments of an x-ray tube.
Figure 1B:
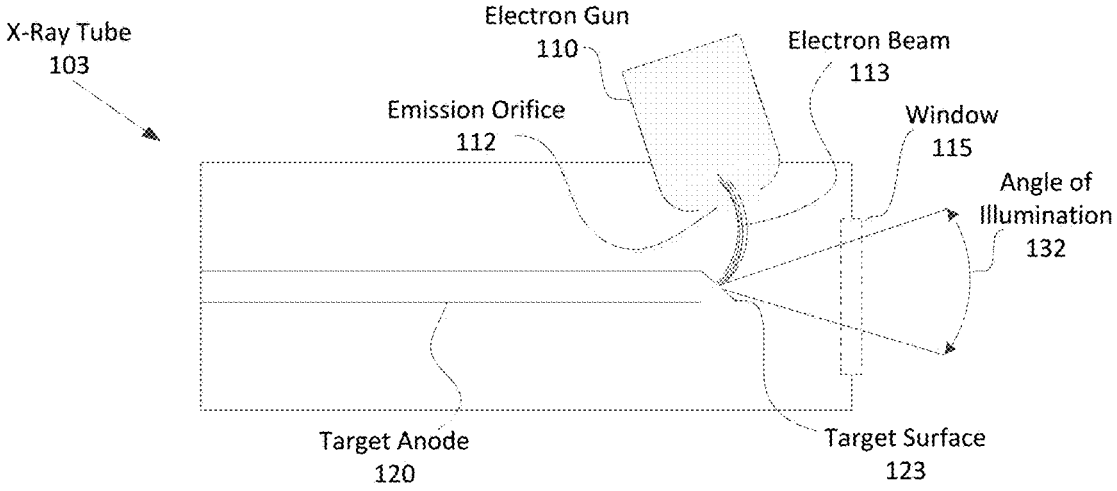
Figure 1C:
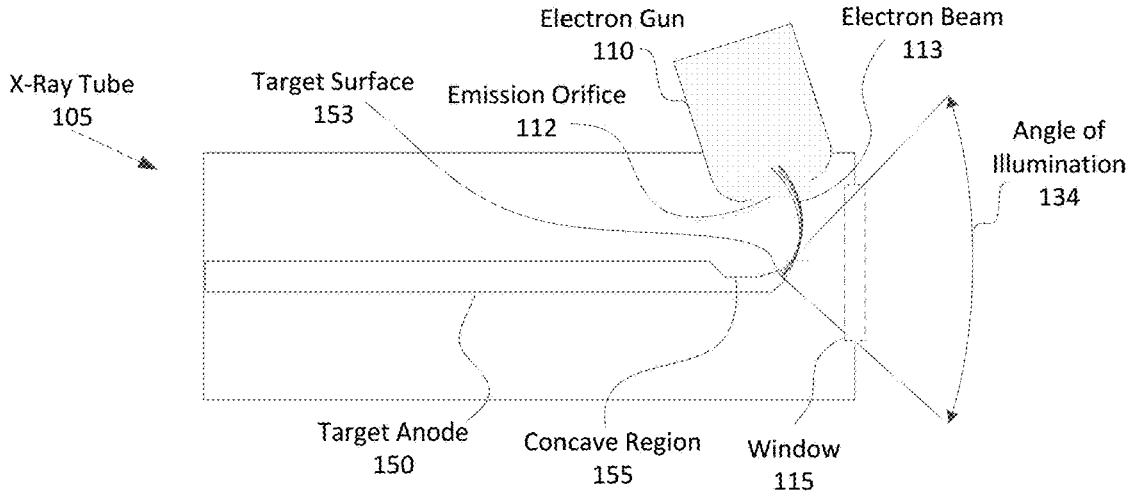

FIGS. 1A-C provide simplified examples of x-ray tube configurations that illustrate how various angles of illumination can be achieved (also referred to as a cone of illumination both of which may be used interchangeably herein). In the present example, FIG. 1A illustrates x-ray tube 100 with target anode 120 that comprises beveled target surface 123 positioned so that electron gun 110 emits electron beam 113 via emission orifice 112 which interacts with target surface 123 and generates x-ray emissions. The x-rays are emitted within the range of angle of illumination 130 through window 115. As FIG. 1A illustrates, electron gun 110 is positioned at about 90° relative to the longitudinal plane of target anode 120. Importantly, the geometry of target anode 120 and positional relationship with electron gun 110 limits the range of angle of illumination 130 due to the considerations described above. In other words, the configuration illustrated in FIG. 1A requires a substantial distance between target anode 120 and window 115 to maintain voltage standoff and avoid the risk of arc-over of electron beam 113.

Next, FIG. 1B illustrates a configuration that achieves better performance that the configuration illustrated in FIG. 1A. For example the risk of arc-over of electron beam 113 is lowered by angling electron gun 110 by some degree, and thus the distance between target surface 123 and window 115 can be reduced which results in a wider range for angle of illumination 132 relative to the configuration of FIG. 1A.

Last, FIG. 1C illustrates a configuration of one embodiment of the presently described invention that achieves an even better level of performance than the configuration illustrated in FIG. 1B. For example, electron gun 110 comprises a substantially similar angle to that illustrated in FIG. 1B although the distance to window 115 is smaller than the minimum distance achievable by the embodiment illustrated in FIG. 1B. This is due, at least in part, to the fact that target anode 150 comprises a substantially different geometry relative to target anode 120. In the present example, target anode 150 comprises concave region 155 that has a reduced cross section in one or more dimensions relative to a central portion of target anode 150. As will be discussed in greater detail below, concave region 155 also enables a reduction in the distance between electron gun 110 and target surface 153 as compared to other embodiments. Further, target surface 153 comprises a substantially reduced dimension relative to other embodiments.

Each of FIGS. 1A-C each provide an illustrative example of window 115, substantially dimensioned to encompass the dimension of angles of illumination 130, 132, and 134 respectively. Also, in each example window 115 is positionally located in a region substantially at an end of x-ray tube 105 and may include any suitable compositions known in the related art, such as for example a beryllium, diamond, or a graphenic carbon composition. In some embodiments window 115 may also include a coating or film. Further, while FIGS. 1A-C are 2-dimensional illustrations it will be appreciated that window 115 may be substantially circular (e.g. to coincide with a 3 dimensional cone shape of illumination provided by of angles of illumination 130, 132, and 134).

Figure 2:
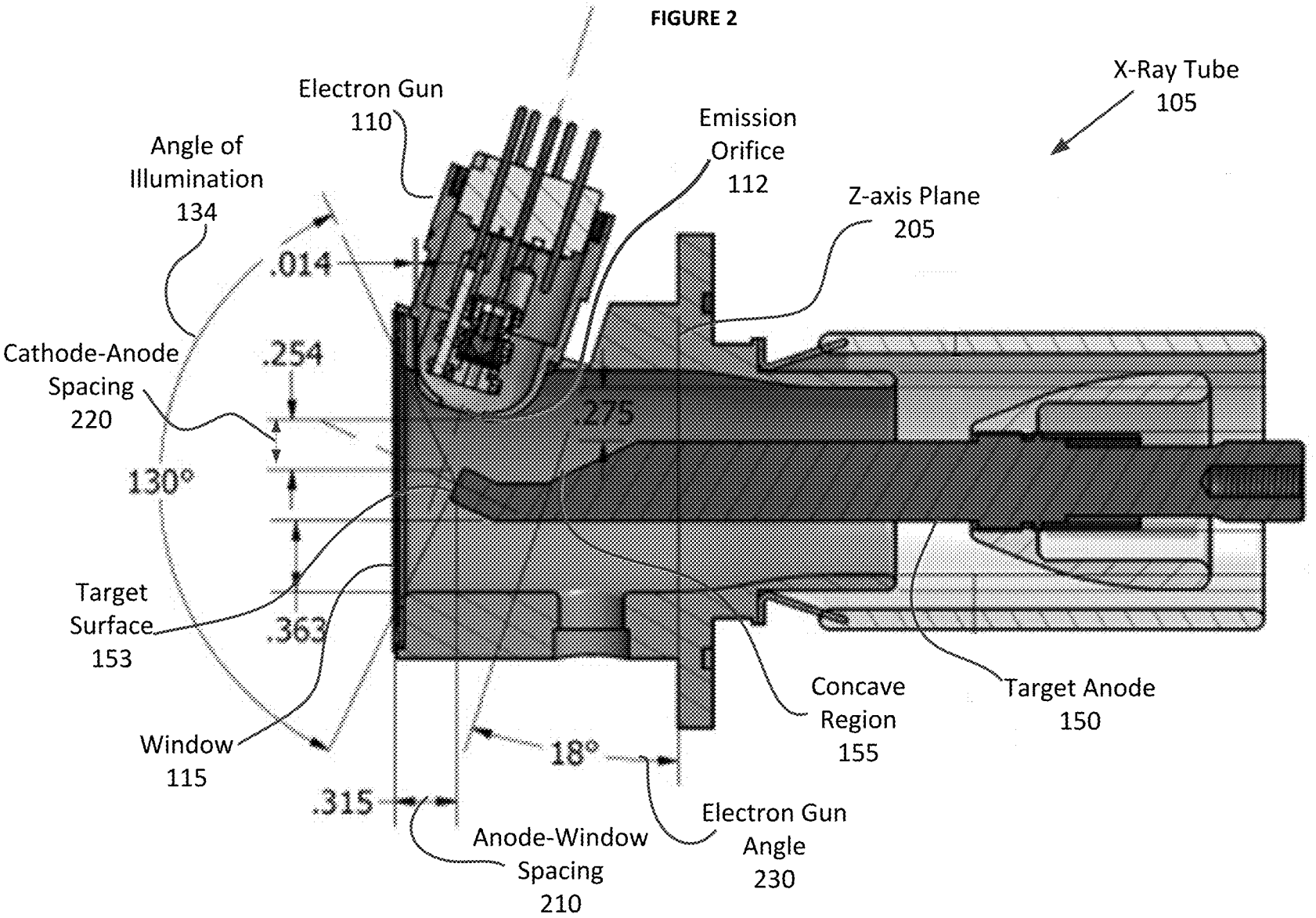
FIG. 2 is a simplified graphical representation of the x-ray tube embodiment of FIG. 1C.

FIG. 2 provides a more specific illustrative example of x-ray tube 105 from FIG. 1C. Importantly, x-ray tube 105 is configured to provide a number of improvements over previous embodiments that include, but are not limited to: 1) a substantially large angle of illumination (sometimes referred to as a "cone of illumination"); 2) a minimal flight path distance of the electron beam; 3) a very small focal spot on the target surface (e.g. electron beam waist dimension); 4) efficient heat dissipation at high power (e.g. including a power in a range of about 90-130 KV); 5) reduced voltage stress in critical areas; and 5) a substantially small FOD for maximum geometric magnification. For example, the improved configuration of x-ray tube 105 includes dimensions designed to take the voltage breakdown into consideration and in particular include the necessary headroom to avoid breakdown. Embodiments of the invention employ less than 25 KV/mm in design, more often less than 20 KV/mm. Also, in the present example a small amount of leakage current is acceptable with some embodiments comprising an operational leakage current below 1.0 uA, and maintain less than 5.0 uA when over-voltage.

In the embodiments described herein, x-ray tube 105 comprises angle of illumination 134 which defines the area of exposure of the x-ray emissions that pass through window 115 from target surface 153. As described above, FIG. 2 provides a 2-dimensional illustration of angle of illumination 134, however it will be appreciated that the area illuminated by angle of illumination 134 typically includes a 3-dimensional area that may be substantially cone shaped. As illustrated in the example of FIG. 2, angle of illumination 134 includes an area of exposure of at least about 130° that, in some embodiments, substantially matches the dimensions of window 115. It is important to note that such a large area defined by angle of illumination 134 is enabled by, at least in part, the ability to position target surface 153 in very close proximity to window 115 (e.g. a very small distance) without the risk of arc-over.

It will be appreciated that the close proximity between window 115 and target surface 153, illustrated in FIG. 2 as anode-window spacing 210 which may include a distance of about 0.315 mm. Anode-window spacing 210 is enabled, at least in part, by the ability to position emission orifice 112 of electron gun 110 in close proximity to target surface 153 (e.g. a very small distance) which minimizes flight path distance of the electron beam. The distance between emission orifice 112 and target surface 153 is illustrated in FIG. 2 as cathode-anode spacing 220 and may include a distance of about 0.254 mm. It will be appreciated that exact dimensions described herein may be relative to the overall dimension of x-ray tube 105 and associated components and thus should not be considered as limiting.

In the described embodiments, it is important that cathode-anode spacing 220 comprises a very small distance which contributes to a very small spot size of electron beam 113 on target surface 153. However, it will be appreciated that cathode-anode spacing 220 is affected by the voltage standoff characteristics between electron gun 110 and target anode 150. For example, in some or all of the described embodiments it is highly desirable to use an extremely high voltage (e.g. 90-130 KeV) for target anode 150 in high resolution applications. Given that electron gun 110 is maintained at a substantially ground level voltage the significant voltage standoff distance may be required between the closest points of target anode 150 and electron gun 110. In the present example, target surface 153 is the closest point so that electron beam 113 focuses to a spot size in the range of about 2-6 μm on target surface 153. Continuing with the present example, a spot size of about 6 μm produces a desirable level of what is referred to as "geometric magnification" for high resolution imaging applications (e.g. ratio of the Focus Detector Distance (FDD) to the Focus Object Distance (FOD)).

In the embodiments described herein one or more features contribute to the minimized distance of cathode-anode spacing 220. A first feature includes electron gun angle 230 that generally refers to the angle at which electron gun 110 is positioned in x-ray tube 105 relative to one or more components and/or a plane or axis. As illustrated in FIG. 2, electron gun 110 is operatively connected to a housing of x-ray tube 105 that may include an outer cylinder of a vacuum chamber so that emission orifice 112 is located within the vacuum chamber. In the described embodiments electron gun angle 230 may comprise an angle in the range of 10°-45° relative to Z-axis plane 205 (e.g. 0°) and orients emission orifice 112 in the direction towards window 115. More specifically, electron gun angle 230 may tilt emission orifice 112 towards window 115 at an angle of about 18° relative to Z-axis plane 205 as illustrated in the example of FIG. 2.

Another feature that contributes to the minimized distance of cathode-anode spacing 220 comprises concave region 155 of target anode 150 that comprises a smaller cross-section dimension in one or more planes than at least a central portion of target anode 150. In particular concave region 155 comprises a smaller cross section on a side that faces towards and is in closest in proximity to electron gun 110. Concave region 155 enables proximal positioning of target surface 153 to electron gun 110 as well as to window 115, while maintaining an appropriate degree of voltage standoff from target anode 150. The positioning of target surface 153 to electron gun 110 and window 115 allows electron beam 113 to accurately hit target surface 153 with a very small focal spot (e.g. target surface 153 comprises the closest point to electron gun 110) and produce a large angle of illumination 134. Also, the electron flight path from emission orifice 112 to target surface 153 is very short which can enable use of a lower electron gun voltage. For example, concave region 155 is proportioned with a dimension that is substantially complimentary to the outer surface of electron gun 110 as positioned in x-ray tube 105 (e.g. at electron gun angle 230) where the dimension provides the voltage standoff distance needed between target anode 150 (e.g. the portion that is not part of target surface 153) and electron gun 110. In other words, concave region 155 includes a shape that is arched inward towards the center of target anode 150 over a distance that is proximal to the outer edge of electron gun 110. In the presently described example, the complimentary proportion of concave region 155 allows a closer positioning of target surface 153 to emission orifice 112 than can be obtained in previous embodiments where the target anode has a uniform cross section from a central portion to the reflective face.

Figure 3A:
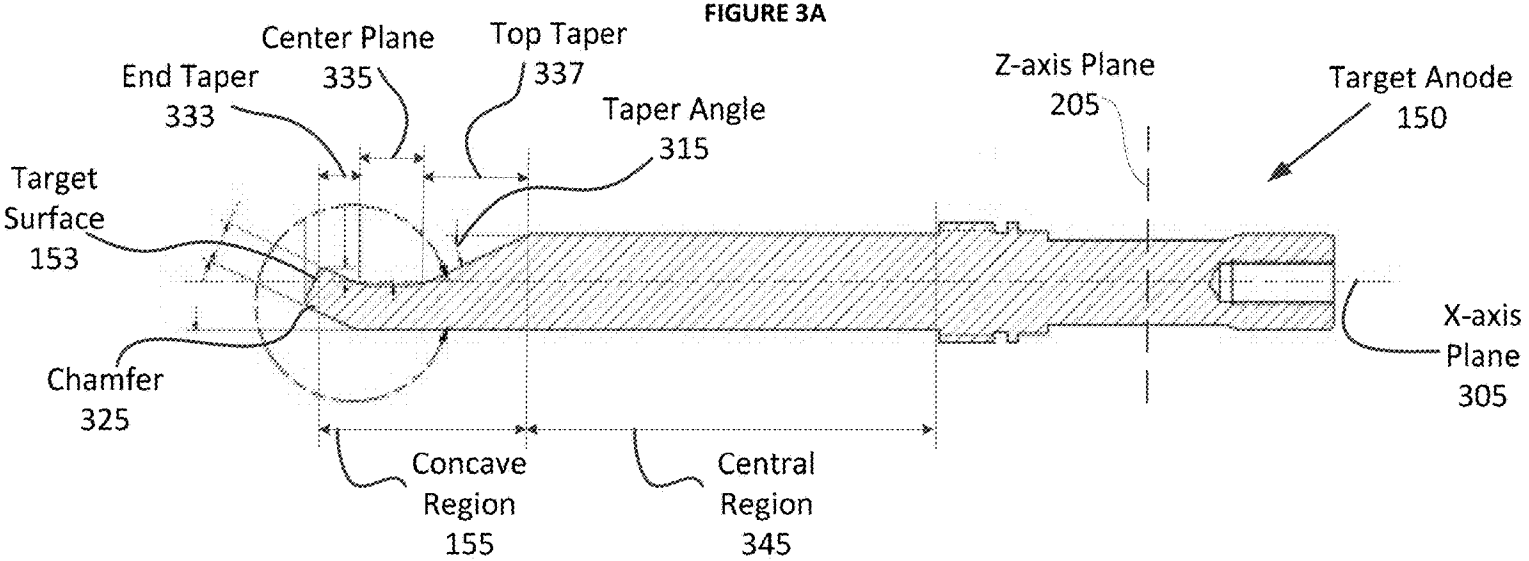
FIGS. 3A-B are simplified graphical representations of a target anode of FIGS. 1C and 2.
Figure 3B:
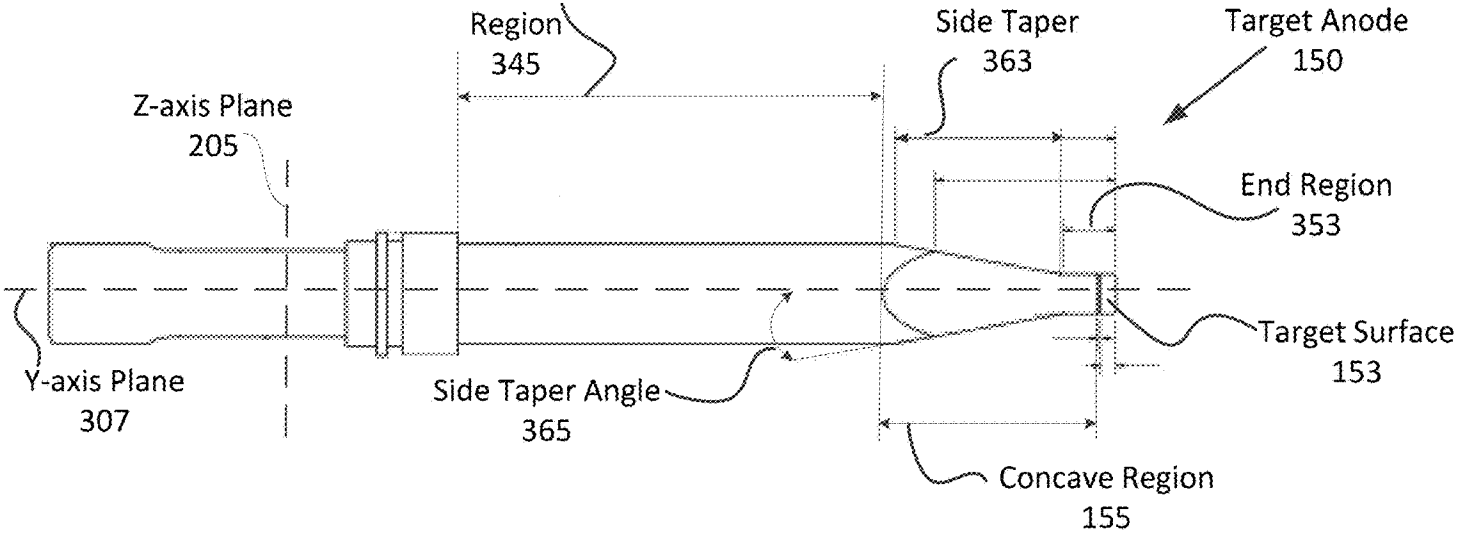

FIGS. 3A-B provide more detailed examples of a side view (FIG. 3A) and a top view (FIG. 3B) of target anode 150 which illustrates concave region 155 that decreases in cross section in one or more dimensions relative to central region 345. In the described embodiments, central region 345 may include a rod shape comprising a substantially cylindrical or oval diameter. However, the rod shape of central region 345 may also include other configurations such a polygonal cross section having planar surfaces (e.g. square, rectangular, octagonal, etc.). Importantly, central region 345 comprises a cross section that maximizes its thermal conductivity characteristics given its effect to the electrical fields within x-ray tube 105 (e.g. target surface 153 operates at high voltage while the opposite end of target anode 150 is maintained substantially at ground potential). Also, concave region 155 comprises a sufficient cross section for effective thermal conductivity and mechanical stability while providing an effective standoff voltage from electron gun 110.

As illustrated in FIG. 3A, concave region 155 comprises top taper 337, center plane 335, and end taper 333. In the described embodiments, top taper 337 decreases the cross section from central region 345 according to taper angle 315 to central plane 335 where the cross section is substantially uniform. Taper angle 315 may be relative to the plane of the outer surface of central region 345 (e.g. which may be substantially parallel to x-axis plane 305). Center plane 335 includes a length (e.g. substantially complimentary to the outer dimension of electron gun 110) that meets end taper 333 that rises relative to the plane of the top surface of center plane 335 and comprises a length to position target surface 153 at the proper distance from emission orifice 112. In some embodiments the angle of rise may include an angle that is substantially the same as taper angle 315 (e.g. about 25°). While FIG. 3A illustrates top taper 337, center plane 335, and end taper 333 as substantially planar surfaces with angular corners, it will also be appreciated that similar dimensions may be achieved using rounded sides and thus the planar/angular nature should not be considered as limiting.

Figure 4A:
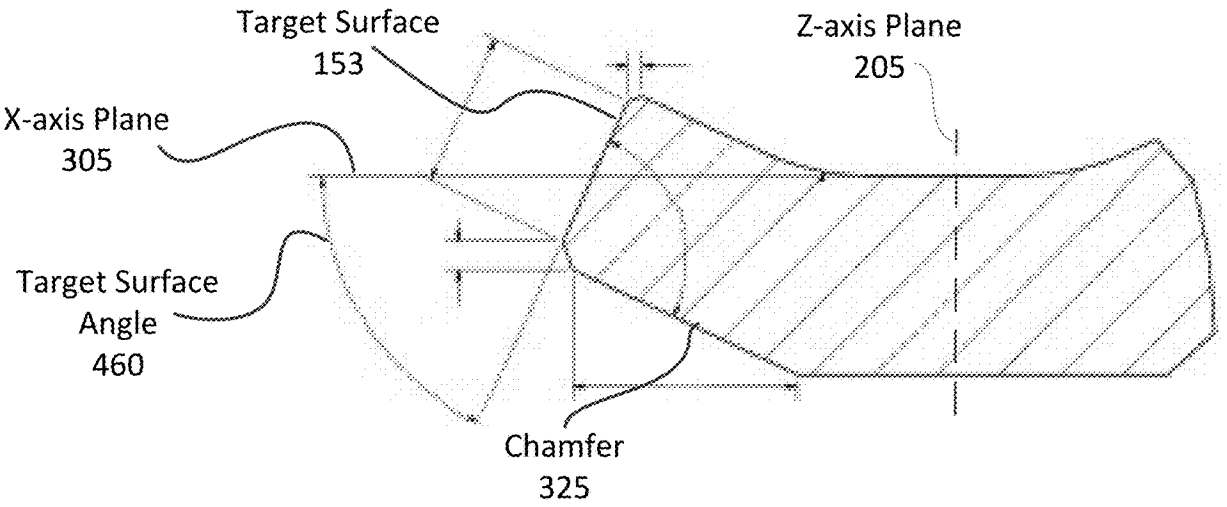
FIGS. 4A-B are simplified graphical representations of a specific regions of the target anode of FIGS. 1C, 2, and 3A-B.

Additionally, some embodiments may also include chamfer 325 that may have a substantially similar angle of rise as end taper 333. FIG. 4A provides a further magnified view of chamfer 325, and target surface 153 oriented according to target surface angle 460 relative to x-axis plane 305. Target surface angle 460 optimally orients target surface 153 relative to emission orifice 112 and window 115 to maximize the degree of angle of illumination 134 and may include an angle in the range of about 45°-85°. More specifically some embodiments may include target surface angle 460 of about 65°. For example, top taper 337 decreases the cross section of concave region 155 at an angle of about 25° from the plane of the outer surface of central region 345 to center plane 335 that has a dimension of about ½ the cross section of central region 345. End taper 333 rises from the distal end of center plane 335 at an angle of about 25° for a distance that optimally positions target surface 153 at a distance from emission orifice 112 that provides a small spot size and window 115 for a large, unobstructed angle of illumination 134. In the present example, target surface angle 460 is aligned with window 115 at the smallest angle that maintains electron focusing and a very small focal spot while providing a large angle of illumination 134.

Figure 4B:
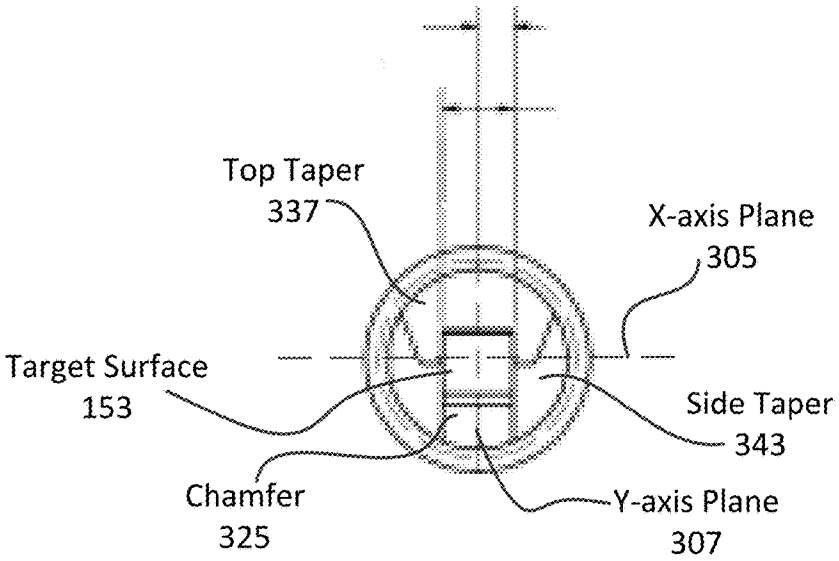

FIG. 3B illustrates a top view of concave region 155 comprising side taper 363 that decreases the cross section from central region 345 in a lateral dimension towards y-axis plane 307 according to side taper angle 365. Side taper 363 includes a length that meets end region 353 at the distal end (e.g. end region 353 includes end taper 333 and target surface 153 from FIG. 3A). End region 353 comprises a substantially uniform cross section with substantially parallel (e.g. the lateral sides may be substantially parallel to y-axis plane 307). FIG. 4B provide a further magnified view from the end of target surface 153 which shows a more detailed view of top taper 337, side taper 343, and chamfer 325 relative to x-axis plane 305 and y-axis plane 307. For example, side taper angle 365 may include an angle of about 10° that reduces the cross section to a dimension of about ½ the cross section of central region 345.

As described above, concave region 155 comprises sufficient thermal conductivity to effectively conduct heat from target face 153 to central region 345. In the described embodiments, central region 345 has greater thermal conductivity characteristics than concave region 155 due, at least in part, to the greater cross section. Importantly, in some or all of the described embodiments target anode 150 is constructed from a material with high thermal conductivity characteristics. Such materials may include, but are not limited to, copper (Cu), graphite (C), molybdenum (Mo), or other material with desirable characteristics. It will also be appreciated that target surface 153 may also be constructed from a variety of materials with desirable characteristics that include, but are not limited to molybdenum (Mo), rhodium (Rh), and tungsten (W).

Having described various embodiments and implementations, it should be apparent to those skilled in the relevant art that the foregoing is illustrative only and not limiting, having been presented by way of example only. Many other schemes for distributing functions among the various functional elements of the illustrated embodiments are possible. The functions of any element may be carried out in various ways in alternative embodiment.

What is claimed is:

1. An X-ray tube comprising:

an outer cylinder;

a window positioned on an end of the outer cylinder;

an electron gun comprising an emission orifice, wherein the electron gun is coupled to a side of the outer cylinder at an angle that orients the emission orifice toward the window; and a rod centrally positioned within the outer cylinder, wherein the rod comprises a concave geometry at a distal end proximal to the electron gun and a target surface configured at an angle that orients the target surface towards the emission orifice, wherein the concave geometry is configured to position the target surface to have a focal spot size of an electron beam from the emission orifice in a range of about 2-6 μm.

2. The X-ray tube of claim 1, wherein:

the concave geometry is configured to position the target surface to have an angle of illumination of x-rays through the window of at least about 130°.

3. The X-ray tube of claim 1, wherein:

the concave geometry comprises a taper on a side facing the electron gun that decreases a cross section of the rod toward the distal end from a central region of the rod.

4. The X-ray tube of claim 1, wherein:

the concave geometry comprises a lateral taper that decreases a cross section of the rod toward the distal end from a central region of the rod.

5. The X-ray tube of claim 1, wherein:

the concave geometry is substantially complimentary to an outer dimension of the electron gun.

6. The X-ray tube of claim 1, wherein:

the angle of the coupled electron gun is in a range of between about 10° and about 45°.

7. The Z-ray tube of claim 6, wherein:

the angle of the coupled electron gun is about 18°.

8. The X-ray tube of claim 1, wherein:

the angle of the target surface is in a range of between about 45° and about 85°.

9. The X-ray tube of claim 8, wherein:

the angle of the target surface is about 65°.

10. The X-ray tube of claim 1, wherein:

the target surface comprises a material selected from a group consisting of molybdenum (Mo), rhodium (Rh), and tungsten (W).

11. The X-ray tube of claim 1, wherein:

the rod comprises a material selected from a group consisting of copper (Cu), graphite (C) and molybdenum (Mo).

12. The X-ray tube of claim 1, wherein:

the target surface is positioned about 0.315 mm from the window.

13. The X-ray tube of claim 1, wherein:

the target surface is positioned about 0.254 mm from the emission orifice.

14. The X-ray tube of claim 1, wherein:

the rod comprises a substantially cylindrical or oval diameter.

15. The X-ray tube of claim 1, wherein:

the rod comprises a polygonal cross section having substantially planar surfaces.

16. The X-ray tube of claim 1, wherein:

the focal spot size comprises a diameter of about 6 μm.

* * * * *